US011259377B2

(12) United States Patent
Serra et al.

(10) Patent No.: US 11,259,377 B2
(45) Date of Patent: Feb. 22, 2022

(54) COLOR TEMPERATURE AND INTENSITY CONFIGURABLE LIGHTING FIXTURE USING DE-SATURATED COLOR LEDS

(71) Applicant: ABL IP Holding LLC, Atlanta, GA (US)

(72) Inventors: John G. Serra, Pingree Grove, IL (US); Gregory Frankiewicz, Elmhurst, IL (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/876,282

(22) Filed: May 18, 2020

(65) Prior Publication Data

US 2020/0367335 A1 Nov. 19, 2020

Related U.S. Application Data

(60) Provisional application No. 62/849,371, filed on May 17, 2019.

(51) Int. Cl.
*H05B 45/20* (2020.01)
*F21V 23/00* (2015.01)
(Continued)

(52) U.S. Cl.
CPC ..... *H05B 45/20* (2020.01); *F21V 23/003* (2013.01); *F21V 23/04* (2013.01); *H05B 45/10* (2020.01);
(Continued)

(58) Field of Classification Search
None
See application file for complete search history.

(56) References Cited

U.S. PATENT DOCUMENTS 6,201,351 B1 3/2001 Rudolph et al.
6,323,598 B1 11/2001 Guthrie et al.
(Continued)

FOREIGN PATENT DOCUMENTS

CN 106555981 4/2017
EP 2768283 8/2014
(Continued)

OTHER PUBLICATIONS

"2x4 LED Flat Panel", Cybertech, Main Place Lighting, Available Online At: https://shopmainplacelighting.com/collections/commercial-lighting/products/2-x-4-led-flat-panel-1, Accessed from Internet on May 14, 2019, 3 pages.
(Continued)

*Primary Examiner* — Crystal L Hammond
(74) *Attorney, Agent, or Firm* — Kilpatrick Townsend & Stockton LLP

(57) ABSTRACT

Certain aspects involve a lighting fixture including multiple de-saturated color LED groups and in which the color temperature and intensity of the generated light can be selectively modified. The lighting fixture is driven by a multi-channel driver that independently controls the multiple de-saturated color LED groups. In one example, the de-saturated color LED groups are made with the same Indium gallium nitride (InGaN) LED, as to maintain all electrical/thermal characteristics. The color temperature and intensity of the lighting fixture are adjusted by managing the intensity of each of the de-saturated color LED groups according to a lookup table or a formula describing the relationship between the intensities of the de-saturated color LED groups and the color temperature and intensity of the lighting fixture. Because de-saturated color LEDs are used in the lighting fixture, dynamic dimming or "warm dim" can be achieved to replicate the effect of an incandescent lamp.

20 Claims, 4 Drawing Sheets

(51) Int. Cl.

| | |
|---|---|
| ***F21V 23/04*** | (2006.01) |
| ***H05B 45/10*** | (2020.01) |
| ***H05B 45/325*** | (2020.01) |
| ***F21Y 113/13*** | (2016.01) |
| ***F21Y 115/10*** | (2016.01) |

(52) U.S. Cl.
CPC ..... *H05B 45/325* (2020.01); *F21Y 2113/13* (2016.08); *F21Y 2115/10* (2016.08)

(56) References Cited

U.S. PATENT DOCUMENTS 6,995,355 B2 2/2006 Rains, Jr. et al.
7,014,336 B1 3/2006 Ducharme et al.
7,088,059 B2 8/2006 McKinney et al.
7,135,664 B2 11/2006 Vornsand et al.
7,173,383 B2 2/2007 Vornsand et al.
7,329,998 B2 2/2008 Jungwirth
7,416,312 B1 8/2008 McDermott
7,423,387 B2 9/2008 Robinson et al.
7,497,590 B2 3/2009 Rains, Jr. et al.
7,520,634 B2 4/2009 Ducharme et al.
7,883,239 B2 2/2011 Rains, Jr. et al.
8,172,415 B2 5/2012 Wegh et al.
8,203,260 B2 6/2012 Li et al.
8,228,002 B2 7/2012 Newman, Jr. et al.
RE43,606 E 8/2012 Bruwer
8,317,362 B2 11/2012 Ku et al.
8,373,362 B2 2/2013 Chemel et al.
8,436,549 B2 5/2013 Hasnain
8,598,809 B2 12/2013 Negley et al.
8,633,650 B2 1/2014 Sauerlaender
8,638,045 B2 1/2014 Kunst et al.
8,669,722 B2 3/2014 Yeh et al.
8,710,754 B2 4/2014 Baddela et al.
8,791,642 B2 7/2014 van de Ven et al.
8,823,289 B2 9/2014 Linz et al.
8,872,438 B2 10/2014 Zhou et al.
8,878,443 B2 11/2014 Luo et al.
8,890,419 B2 11/2014 Stack
8,890,436 B2 11/2014 Chou
8,914,312 B2 12/2014 McLaughlin et al.
8,928,249 B2 1/2015 Raj et al.
8,941,312 B2 1/2015 McRae
8,975,823 B2 3/2015 Yang et al.
9,055,647 B2 6/2015 Sutardja et al.
9,072,149 B2 6/2015 Wu et al.
9,125,271 B2 9/2015 Martins et al.
9,144,131 B2 9/2015 Wray
9,210,760 B2 12/2015 Sanders et al.
9,277,607 B2 3/2016 Ramer et al.
9,289,269 B2 3/2016 Valteau et al.
9,301,359 B2 3/2016 Wray
9,374,876 B2 6/2016 Alpert et al.
9,386,653 B2 7/2016 Kuo et al.
9,414,457 B2 8/2016 Fukuda et al.
9,485,826 B2 11/2016 Bohler et al.
9,538,603 B2 1/2017 Shearer et al.
9,538,604 B2 1/2017 Yadav et al.
9,544,951 B1 1/2017 O'Neil et al.
9,544,969 B2 1/2017 Baddela et al.
9,554,441 B2 1/2017 Sutardja et al.
9,560,710 B2 1/2017 Beijer et al.
9,603,213 B1 3/2017 Suttles et al.
9,665,262 B2 5/2017 Hole
9,719,642 B1 8/2017 Macias
9,730,291 B1 8/2017 Janik et al.
9,801,250 B1 10/2017 Halliwell
9,820,350 B2 11/2017 Pyshos et al.
9,892,693 B1 2/2018 Kumar et al.
9,900,945 B1 2/2018 Janik et al.
10,091,855 B2 10/2018 Van Winkle
10,117,300 B2 10/2018 Doheny et al.
10,163,405 B2 12/2018 Kumar et al.
10,290,265 B2 5/2019 Kumar et al.
10,292,233 B1 5/2019 Udavant et al.
10,299,335 B2 5/2019 Pyshos et al.
10,299,336 B2 5/2019 Bowen et al.
10,299,337 B1 5/2019 Chen et al.
10,448,471 B1 10/2019 Chowdhury et al.
10,575,380 B2 2/2020 Udavant et al.
10,660,174 B2 5/2020 Huang et al.
10,674,579 B2 6/2020 Bruckner et al.
10,681,784 B2 6/2020 Bruckner et al.
10,856,384 B2 12/2020 Chen et al.
10,904,970 B2 1/2021 Udavant et al.
11,026,307 B2 6/2021 Rodriguez
2005/0162851 A1 7/2005 Kazar et al.
2005/0243022 A1 11/2005 Negru
2006/0220586 A1 10/2006 Latham
2006/0226795 A1 10/2006 Walter et al.
2006/0238136 A1 10/2006 Johnson Iii et al.
2006/0285310 A1 12/2006 Shyu
2007/0159750 A1 7/2007 Peker et al.
2007/0262724 A1 11/2007 Mednik et al.
2008/0130298 A1 6/2008 Negley et al.
2009/0026913 A1 1/2009 Mrakovich
2009/0218960 A1 9/2009 Lyons et al.
2009/0256483 A1 10/2009 Gehman et al.
2010/0097406 A1* 4/2010 Zulch ..... G09G 3/006 345/690
2010/0141175 A1 6/2010 Hasnain et al.
2010/0171633 A1 7/2010 Baker et al.
2010/0207534 A1 8/2010 Dowling et al.
2010/0214764 A1 8/2010 Chaves et al.
2010/0283322 A1 11/2010 Wibben
2010/0308738 A1 12/2010 Shteynberg et al.
2011/0058372 A1 3/2011 Lerman et al.
2011/0062872 A1 3/2011 Jin et al.
2011/0068702 A1 3/2011 van de Ven et al.
2011/0084615 A1 4/2011 Welten
2011/0115407 A1 5/2011 Wibben et al.
2011/0210678 A1 9/2011 Grajcar
2011/0273495 A1* 11/2011 Ward ..... G09G 3/3413 345/694
2011/0316441 A1 12/2011 Huynh
2012/0080944 A1 4/2012 Recker et al.
2012/0081009 A1 4/2012 Shteynberg et al.
2012/0098460 A1 4/2012 Miyasaka et al.
2012/0242247 A1 9/2012 Hartmann et al.
2012/0253542 A1 10/2012 Nurmi et al.
2012/0286753 A1 11/2012 Zhong et al.
2013/0002167 A1 1/2013 Van de Ven
2013/0021580 A1 1/2013 Morgan et al.
2013/0038222 A1 2/2013 Yeh et al.
2013/0049610 A1 2/2013 Chen
2013/0082616 A1 4/2013 Bradford et al.
2013/0140988 A1 6/2013 Maxik et al.
2013/0141013 A1 6/2013 Kodama et al.
2013/0169158 A1 7/2013 He et al.
2013/0200806 A1 8/2013 Chobot
2013/0229125 A1 9/2013 Yan et al.
2013/0249422 A1 9/2013 Kerstens et al.
2013/0249440 A1 9/2013 Doshi et al.
2013/0343052 A1 12/2013 Yen
2014/0001959 A1 1/2014 Motley et al.
2014/0035472 A1 2/2014 Raj et al.
2014/0042920 A1 2/2014 Chou
2014/0184076 A1 7/2014 Murphy
2014/0197750 A1 7/2014 Cash
2014/0210357 A1 7/2014 Yan et al.
2014/0210364 A1 7/2014 Cash et al.
2014/0252967 A1 9/2014 Van de Ven et al.
2014/0312777 A1 10/2014 Shearer et al.
2015/0009666 A1 1/2015 Keng et al.
2015/0097489 A1 4/2015 Wu et al.
2015/0245441 A1 8/2015 McCune, Jr.
2015/0256760 A1* 9/2015 Ju ..... H04N 5/243 348/256
2015/0351169 A1 12/2015 Pope et al.
2015/0359061 A1 12/2015 Adler
2016/0007420 A1 1/2016 Gong et al.
2016/0098950 A1* 4/2016 Nicholson ..... G09G 3/2003 345/55

(56) References Cited

U.S. PATENT DOCUMENTS

| | | | | |
|---|---|---|---|---|
| 2016/0128155 | A1 | 5/2016 | Petluri et al. | |
| 2016/0323949 | A1 | 11/2016 | Lee | |
| 2016/0352975 | A1* | 12/2016 | Kervec | G09G 5/026 |
| 2016/0363308 | A1 | 12/2016 | Shum | |
| 2016/0366746 | A1 | 12/2016 | Van de Ven et al. | |
| 2016/0374177 | A1 | 12/2016 | Chen | |
| 2017/0019973 | A1 | 1/2017 | Beck et al. | |
| 2017/0027033 | A1 | 1/2017 | Chobot et al. | |
| 2017/0086265 | A1 | 3/2017 | Akiyama et al. | |
| 2017/0086280 | A1 | 3/2017 | Boomgaarden et al. | |
| 2017/0135186 | A1 | 5/2017 | O'Neil et al. | |
| 2017/0164440 | A1 | 6/2017 | Hu et al. | |
| 2017/0238392 | A1 | 8/2017 | Shearer et al. | |
| 2017/0303363 | A1 | 10/2017 | Pyshos et al. | |
| 2017/0354013 | A1* | 12/2017 | DeMayo | H05B 47/125 |
| 2018/0035510 | A1 | 2/2018 | Doheny et al. | |
| 2018/0103523 | A1 | 4/2018 | Yan et al. | |
| 2018/0116029 | A1 | 4/2018 | Pyshos et al. | |
| 2018/0166026 | A1 | 6/2018 | Kumar et al. | |
| 2018/0242422 | A1 | 8/2018 | Choi et al. | |
| 2018/0249547 | A1 | 8/2018 | Wang et al. | |
| 2018/0310381 | A1 | 10/2018 | Bowen et al. | |
| 2018/0368218 | A1* | 12/2018 | Petluri | F21K 9/00 |
| 2018/0368232 | A1 | 12/2018 | Doheny et al. | |
| 2019/0027099 | A1 | 1/2019 | Kumar et al. | |
| 2019/0037663 | A1 | 1/2019 | Van Winkle | |
| 2019/0088213 | A1 | 3/2019 | Kumar et al. | |
| 2019/0141812 | A1 | 5/2019 | Chen | |
| 2019/0191512 | A1 | 6/2019 | Zeng et al. | |
| 2019/0268984 | A1 | 8/2019 | Song et al. | |
| 2019/0268991 | A1 | 8/2019 | Li | |
| 2019/0394851 | A1 | 12/2019 | Sinphay | |

FOREIGN PATENT DOCUMENTS

| | | |
|---|---|---|
| EP | 2728972 | 8/2015 |
| JP | 2011258517 | 12/2011 |
| WO | 2011084135 | 7/2011 |

OTHER PUBLICATIONS

"3 Inch WarmDim/Tunable White", Aculux, Accessed from Internet on May 15, 2020, 3 pages.

"38W LED Panel—Color Selectable", Venture Lighting, Available Online At: https://www.venturelighting.com/led-lighting/indoor-lighting-fixtures/panels-and-troffers/color-selectable-panels/standard-product/pn38592.html, Accessed from Internet on May 14, 2019, 6 pages.

"EASY Lighting Control", Application Guide, OSRAM, Available Online At: www.osram.com/easy, Apr. 2015, 25 pages.

"Human Centric Lighting", Helvar, Intelligent Colour Product Series, Available Online At: helvar.com/second-sun, Dec. 4, 2017, 4 pages.

"iW Cove MX Powercore-Premium Interior Linear LED Cove and Accent Luminaire with Intelligent White Light", Philips Lighting, Product Family Leafelet, Jan. 21, 2019, 3 pages.

"LED Panel 1230 40W Colour Changeable", Fuzion Lighting, Information sheet, Available online At http://www.fuzionlighting.com.au/product/led-panel-40-cct, Accessed from Internet on Mar. 19, 2019, 6 pages.

"LED Universal Ceiling Fan Light Kit", Hampton Bay, Use and Care Guide, Nov. 7, 2019, 22 pages.

"LLP LED Light Panel", Main Place Lighting, Specification Sheet, Available Online At: https://cdn.shopify.com/s/files/1/2048/2207/files/LLP-Specification-Sheet-1.pdf, Accessed from Internet on Mar. 19, 2019, 4 pages.

"Noble Pro LED Line Voltage Task Lighting NLLP Series", AFX, Available Online At: www.AFXinc.com, Accessed from Internet at May 13, 2019, 1 page.

"Par Lite Led", VariWhite, Coemar, User Manual Version 1.0, Jun. 2011, 19 pages.

"ViaCon LED-Products", Trilux Simplify your Light, Available Online At: https://www.trilux.com/en/products/viacon-led/, Accessed from Internet on May 13, 2019, 11 pages.

"Warmdim® & Tunable White Adjustable/downlight/wall Wash 1000 Lumen Led 3" Baffle Down Light Trim AX3 WDTW with 3DBAF Trim", Aculux Luminaire, Mar. 20, 2019, 3 pages.

* cited by examiner

COLOR TEMPERATURE AND INTENSITY CONFIGURABLE LIGHTING FIXTURE USING DE-SATURATED COLOR LEDS

RELATED APPLICATION

This application claims priority to U.S. Prov. App. No. 62/849,371, titled "Color Temperature and Intensity Configurable Lighting Fixture Using De-saturated Color LEDS" and filed on May 17, 2019, which is incorporated herein in its entirety.

TECHNICAL FIELD

This disclosure relates generally to the field of lighting fixtures. More specifically, this disclosure relates to providing multiple configurations of color temperatures and intensities using a single lighting fixture.

BACKGROUND

Lighting fixtures can produce different color temperatures of white light and different intensities to suit the preferences of different consumers or activities. For example, a cool white light may be preferred by some consumers or appropriate for some activities, whereas a warm white light may be preferred by other consumers or appropriate for other activities. Similarly, a consumer might want to reduce the intensity of a lighting fixture in certain circumstances or to increase the intensity of the lighting fixture in other circumstances. In some instances, different lighting fixtures are required to provide light with different color temperatures and intensities. In other instances, one lighting fixture is used to provide different color temperatures and intensities. However, these lighting fixtures may use a combination of white LEDs with different color temperatures and in certain color temperature settings, some LEDs are on and the others are off, leading to the low efficiency of the lighting fixture.

SUMMARY

Aspects and examples involve a lighting fixture using de-saturated color LEDs to provide configurable color temperatures and intensities with a high color rendering index (CRI) and a high efficiency. For instance, a lighting fixture includes a plurality of de-saturated color LED groups. Each de-saturated color LED group is configured to produce light with a color different from one another de-saturated color LED group. The plurality of de-saturated color LED groups includes a de-saturated green LED group, a de-saturated blue LED group and a de-saturated red LED group. The lighting fixture further includes a multi-channel driver and each of the channels of the driver is configured for powering one of the plurality of de-saturated color LED groups. The multi-channel driver is configured for controlling the color temperature of the lighting fixture by controlling the intensity of each of the plurality of de-saturated color LED groups. The ratio between the intensities of the plurality of de-saturated color LED groups is determined based on a color temperature setting programmed in the multi-channel driver.

These illustrative embodiments are mentioned not to limit or define the disclosure, but to provide examples to aid understanding thereof. Additional embodiments are discussed in the Detailed Description, and further description is provided there.

BRIEF DESCRIPTION OF THE DRAWINGS

Features, embodiments, and advantages of the present disclosure are better understood when the following Detailed Description is read with reference to the accompanying drawings, where.

DETAILED DESCRIPTION

Figure 1:
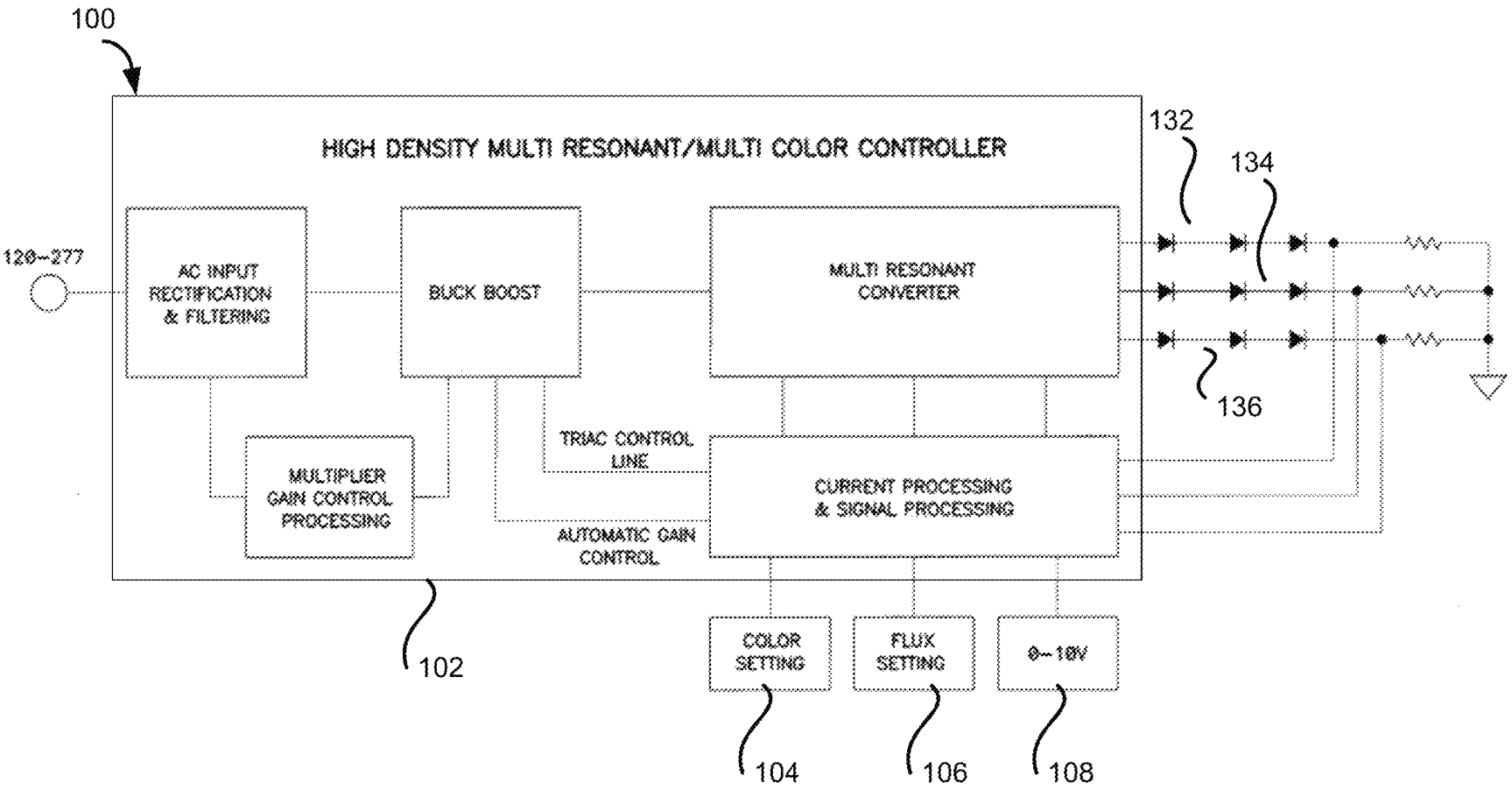
FIG. 1 depicts an example of a block diagram of a lighting fixture driver and LED sources that use de-saturated color LEDs presented herein to control the color temperature and intensity of a lighting fixture, according to certain embodiments of the present disclosure.

Briefly described, the present disclosure generally relates to a lighting fixture using de-saturated color LEDs to provide configurable color temperatures and intensities with a high color rendering index (CRI) and a high efficiency. Based on a color temperature setting, a multi-channel driver of the lighting fixture can independently control the current flowing through each of the de-saturated color LED groups so that the lighting fixture collectively produces light with a color temperature that matches the color temperature setting of the controller. In addition, the driver can be further configured to adjust the intensity of the lighting fixture or dim the lighting fixture while keeping the color temperature at a fixed value or changing the color temperature along the blackbody line as intensity decreases like an incandescent lamp.

In some configurations, the lighting fixture includes multiple de-saturated color LED groups, such as a de-saturated red LED group, a de-saturated green LED group and a de-saturated blue LED group. The lighting fixture further includes a multi-channel LED driver configured to drive the multiple LED groups independently. In one example, the multi-channel LED driver is configured to control the color temperature and intensity of the lighting fixture. In another example, the lighting fixture includes a controller, such as a switch, configured to control the LED driver to achieve different color temperatures based on the color temperature setting at the controller. For simplicity, the following description focuses on controlling the color temperature and intensity of the lighting fixture using the LED driver. The controlling mechanisms can be similarly implemented using the controller if the lighting fixture is configured to use the controller for color temperature and intensity control.

To control the color temperature of the lighting fixture, the driver manages the intensities of the multiple de-saturated color LED groups so that a combination of the light generated by the multiple LED groups has a color temperature that matches the color temperature setting. The intensity of each of the multiple de-saturated color LED groups can be determined using a lookup table stored in the driver or by following a formula describing the relationship between the intensities of the de-saturated color LEDs and the resulting color temperature.

To control the intensity of the lighting fixture, in one configuration, the driver adjusts the current flowing through the LED groups based on a dimming control input, such as a 0-10V dimming control input, a triac control signal or a Bluetooth signal. In one example, the lighting fixture is configured to implement the dimming without changing the color temperature, referred to herein as "static dimming." In another example, the dimming is performed by simultaneously changing the intensity of the lighting fixture and the color temperature of the lighting fixture along the blackbody line, referred to herein as "dynamic dimming" or "warm dim." In the warm dim mode, the lighting fixture has a dimming behavior like an incandescent lamp, which is preferred by some users.

The lighting fixture can include a user interface such as a selectable DIP switch to configure the color temperature, intensity, or dimming mode of the lighting fixture. The lighting fixture can also be controlled by other types of inputs, such as wired or wireless communication interfaces, e.g. Bluetooth communication. In addition, the lighting fixture may include other sensors or inputs which control the light output including, but not limited to, occupancy sensors, daylight sensors, ambient light sensors.

By using the lighting fixture presented herein, different color temperature settings and intensity settings can be provided using a single lighting fixture. Because de-saturated color LEDs are used in the lighting fixture, which have a broader spectral density distribution than saturated color LEDs, a higher CRI can be achieved by the lighting fixture presented herein than lighting fixtures using traditional saturated color LEDs. Further, all the LEDs in the lighting fixture presented herein stay on at any color temperature setting, resulting in higher efficiency of the lighting fixture than the white-LED-based solution.

Referring now to the figures, FIG. 1 depicts an example of a block diagram showing certain components of a lighting fixture 100 that uses de-saturated color LEDs to control the color temperature and intensity of the lighting fixture, according to the present disclosure. In the example shown in FIG. 1, the lighting fixture 100 includes a multi-channel LED driver 102 and three de-saturated color LED groups. The multi-channel LED driver 102 is configured to control the current flowing through each of the three de-saturated color LED groups so that the intensity of the one de-saturated color LED group is controlled independently of the intensity of another de-saturated color LED group.

In one example, the three LED groups include a de-saturated green LED group 132, a de-saturated blue LED group 134 and a de-saturated red LED group 136. Each de-saturated color LED group includes multiple de-saturated color LEDs configured to produce a corresponding de-saturated color. The LEDs in an LED group may be connected in series, in parallel, or in any combination thereof. Individual LEDs in an LED group have the same or similar color. The number of LEDs in an LED group may be the same or may differ between LED groups within the same lighting fixture so long as the LED groups appear balanced to the driver. When the LED groups are powered, the LED groups collectively provide light at a specified color temperature. In another example, the lighting fixture 100 includes LEDs each of which is a single triplet containing three de-saturated color LEDs. These LEDs may be powered by the same LED driver 102 or a different driver configured to power this type of LEDs.

Figure 2:
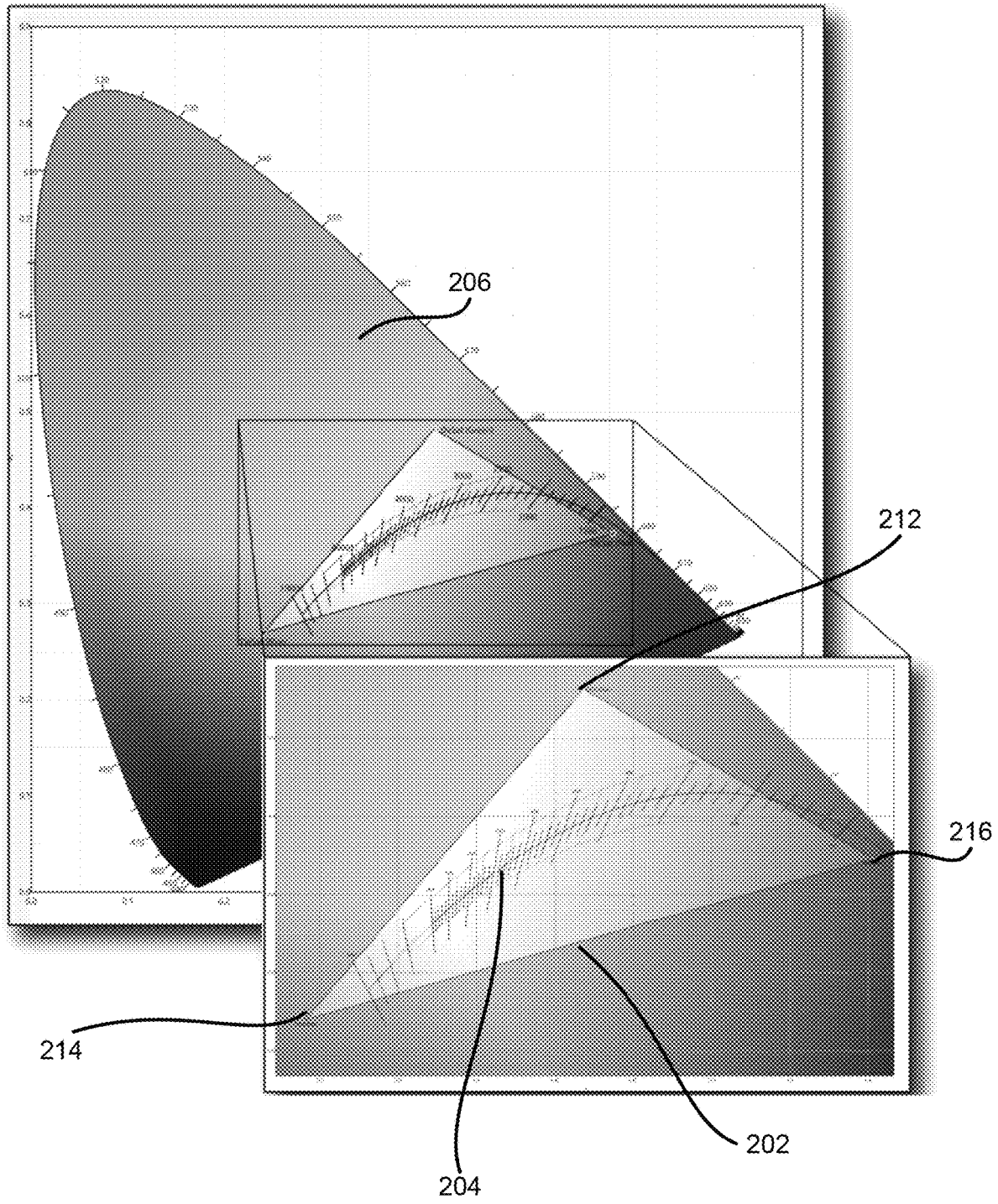
FIG. 2 depicts an example of the color diagram using de-saturated color LEDs to generate light with various color temperatures, according to certain embodiments of the present disclosure.

In some configurations, different LED groups have different de-saturated colors. The de-saturated colors can be defined using coordinates (x,y) in the CIE color space, a spectral power distribution, or a color chart. FIG. 2 depicts an example of the color diagram using de-saturated color LEDs to generate light with various color temperatures, according to the present disclosure. In the example shown in FIG. 2, the de-saturated green color LED group is configured to produce light with color at a coordinate around (x,y)=(0.42, 0.48); the de-saturated blue color LED group is configured to produce light with color at a coordinate around (x,y)=(0.23, 0.27); and the de-saturated red color LED group is configured to produce light with color at a coordinate around (x,y)=(0.61, 0.37). These LED groups are referred to as de-saturated color LED groups because they generate light with a color that lies in the interior of the gamut of human vision 206 in the CIE color space whereas traditional RGB color LED generates light at or close to the border of the gamut of human vision 206 that corresponds to saturated colors.

In one example, the de-saturated "red" LED includes a blue InGaN (Indium Gallium Nitride) based LED that is then converted to a color point in the red area of the gamut of human vision 206 by applying phosphor on the blue InGaN based LED. The conversion can be performed using, for example, potassium fluorosilicate, such as the $K_2SiF_6$ (also referred to as KSF), Nitride Red, Quantum Dot, or a combination thereof. The full width half max (FWHM) of a direct red, 630 nm LED is on the order of 5-10 whereas the phosphor converted "red" could be in the mid 30's broadening the spectral power distribution (SPD) of the produced light. Broadening the SPD is beneficial in a variety of ways. For example, it improves the CRI of the produced light because the LED acts more closely as a broadband emitter and utilizes the efficiency gain in the system by not wasting energy required to bring the light fixture back to the correct color point from a saturated source. Another benefit of creating "red" LEDs in this manner is due to the blue (450 nm), InGaN LED used as its base. As mentioned later in this document, traditional AlInGaP (Aluminum Indium Gallium Phosphide), used in red saturated LEDs, has a thermal quenching problem and usually cannot stand up to the heat in the light fixtures that the blue, InGaN can. A thermal management system is usually required to drive the saturated red in a hot condition due to this phenomenon which adds complexity, drift over time, and cost. By using the blue InGaN LED as the base material for the de-saturated red LEDs, the SPDs of all three (or more) colors are utilized to efficiently create the white light that is desired in the luminaire industry.

In the example shown in FIG. 1, the LED driver 102 includes multiple components represented by various blocks shown in FIG. 1, such as an AC input rectification and filtering block, a buck boost block, and a multiplier gain control processing block. The components corresponding to these three blocks are power components configured to collectively provide power to the LED driver 102. The LED driver 102 also includes control components represented by a multi-resonant converter block and a current and signal processing block. These control components are configured to accept inputs and generate proper current outputs to drive the de-saturated color LED groups 132-136.

For example, the control components of the LED driver 102 are configured to accept a color setting 104 as an input. The color setting 104 specifies a desired color temperature for the lighting fixture 100. Based on the color setting 104, the control components of the LED driver 102 determine the intensity for each de-saturated color LED group so that the combined color temperature generated by the de-saturated color LED groups 132-136 matches the desired color temperature. The intensity of a de-saturated color LED group can be controlled by controlling the root-mean-square (RMS) current flowing through the respective de-saturated color LED groups. The RMS current of a de-saturated color LED group can be controlled by adjusting the current of the de-saturated color LED group or by adjusting the amount of time that the de-saturated color LED group is on through, for example, adjusting the duty cycle of the pulse width modulation (PWM) signal used to control the current of each of the de-saturated color LED groups. Determining the specific intensities of the de-saturated color LED groups for a given color temperature can be performed by querying a look-up table stored in the LED driver 102 or by following a formula describing the relationship between the intensities of the de-saturated color LED groups and the resulting color temperature.

The control components of the LED driver 102 can optimally be configured to accept a flux setting 106 as an input as shown in the example of FIG. 1. The flux setting 106 specifies the lumen level of the lighting fixture 100. For a given flux setting 106, the LED driver 102 determines and manages the intensity of each of the de-saturated color LED group, for example, by querying a lookup table or by following a formula so that the lumen level of the lighting fixture 100 matches the flux setting 106 and the color temperature of the lighting fixture 100 matches the color setting 104. The lookup table used here can be the same lookup table described above for controlling the color temperature. For example, the lookup table also describes the relationship between the intensity or lumen level of the lighting fixture and the intensities of the de-saturated color LED groups. Such a relationship can also be described in a lookup table separate from the lookup table described above. Other implementations are also possible.

The control components of the LED driver 102 may be further configured to accept a 0-10 v signal 108 as a dimming input. The dimming can be performing statically by reducing the intensity of the lighting fixture 100 while maintaining the color temperature of the lighting fixture 100. The dimming can also be performed dynamically by simultaneously changing the color temperature and the intensity of the lighting fixture 100. The dimming of the lighting fixture 100 can also be controlled similarly by using other signals, such as a triac control signal or a Bluetooth signal. Additional details regarding controlling the color temperature and intensity of the lighting fixture 100 are provided with respect to FIG. 2-4.

The various input signals of the LED driver 102 of the lighting fixture 100 can be provided through interfaces such as switches, tactile buttons, break-away PCB tabs or traces. The LED driver 102 can also be controlled by inputs such as wired or wireless communication interfaces, e.g. Bluetooth communication. The blocks or components of the LED driver 102 shown in FIG. 1 are for illustration purposes only, various other ways of implementing the LED driver 102 can also be utilized, such as by utilizing one component to implement the functionalities of two or more components shown in FIG. 1 or by implementing the functionality of a component in FIG. 1 using multiple components.

FIG. 2 depicts an example of a color diagram using de-saturated color LEDs to generate light with a color temperature falling on or near the blackbody curve, according to the present disclosure. In the example shown in FIG. 2, three de-saturated color LED groups are utilized in the lighting fixture 100: a de-saturated green LED group 132 configured to produce light at a point 212 with its full intensity; a de-saturated blue LED group 134 configured to produce light at a point 214 with its full intensity; and a de-saturated red LED group 136 configured to produce light at a point 216 with its full intensity. The triangle area 202 formed by the three color points in the CIE color space represents the color that can be produced by the three de-saturated color LED groups. The portion of the black body curve 204 that falls inside the triangle area 202 represents the "white" color temperate that can be generated by the three de-saturated color LED groups, referred to herein as the "color temperature range."

In the example shown in FIG. 2, the three de-saturated color LED groups can generate color temperature in the range of 1800K to 10000K. In one example, the lighting fixture 100 is configured to generate a limited number of color temperatures within the color temperature range. The color setting 104 can be utilized to specify one of the limited number of color temperatures as the color temperature to be generated by the lighting fixture 100. As described above, the various different color temperatures can be achieved by managing the intensities or RMS currents of the de-saturated color LED groups. To generate light at a given color temperature as specified by the color setting 104, the relative intensities of the de-saturated color LED groups can be determined by following a formula describing the relationship between the intensities of the de-saturated color LED groups and the resulting color temperature or by querying a lookup table stored in the LED driver 102. Based on this determination, the LED driver 102 can control the intensities of the de-saturated color LED groups by independently driving the three de-saturated color LED groups, for example, through managing the currents flowing through the de-saturated color LED groups or the duty cycles of the PWM signals of the de-saturated color LED groups according to the intensities determined based on the formula or the lookup table. The ratio between the intensities of the plurality of de-saturated color LED groups determines the resulting color temperature of the lighting fixture.

Similarly, if the LED driver 102 is configured with a flux setting input 106, the LED driver 102 can control the color temperature at a given flux setting 106. The flux setting 106 can specify the intensity or lumen level of the lighting fixture 100 at various levels ranging from the full intensity to, for example, the half of the full intensity. A lookup table can be built so that the LED driver 102 can determine the RMS currents of the de-saturated color LED groups in order to achieve the color temperature as specified by the color setting 104 and the lumen level as specified by the flux setting 106.

As described briefly above, dimming the lighting fixture 100 can be achieved through input signals such as a 0-10 v dimming signal, a triac control signal or a Bluetooth signal. The LED driver 102 can dim the lighting fixture 100 by keeping the lighting fixture 100 at a static color temperature or by dynamically changing the color temperature. The static and dynamic dimming can be performed similarly as described above, such as by the LED driver 102 determining the RMS currents of the de-saturated color LED groups for the combination of the color temperature, flux setting, and the dimming level. The determination can be made through a look-up table or by following a formula describing the relationship between the intensities of the de-saturated color LED groups and the resulting color temperature, flux level, and dimming level.

The lookup tables for dynamic dimming and static dimming are different since, in static dimming, the color temperature is fixed during the dimming process, whereas in the dynamic dimming, the color temperature changes along the black body curve during the dimming. In one example, the color temperature of the lighting fixture 100 can be configured with a "warm dim" feature, i.e. the color temperature following the blackbody curve 204 by changing to a warmer color temperature when dimming down and changing to a cooler color temperature when dimming up, replicating the effect of an incandescent lamp. This can be achieved because of the use of the multiple de-saturated color LED groups and any color falling inside the triangle area 202 can be achieved by properly driving the de-saturated color LED groups.

In some configurations, the lighting fixture 100 is configured with static dimming for certain color temperature settings and with dynamic dimming for other color temperatures. For instance, the lighting fixture 100 is configured to warm dim when a dimming input is received and when the color temperature is set at 2856K to replicate the effect of an incandescent lamp. At other color temperature settings, such as 2700K, 3000K, 3500K, 4000K, and 5000K, the dimming is performed statically to maintain the color temperature during dimming.

It should be appreciated that because de-saturated color LEDs are used, the spectral power distribution of each LED is broader than traditional saturated RGB LEDs. As a result, the CRI of the generated light is higher than that using traditional RGB LEDs. This allows the lighting fixture to meet user or regulatory requirements related to the CRI. In addition, in one configuration, Indium gallium nitride (InGaN) is used as the base material for all three types of de-saturated LEDs, and thus these LEDs decay at the same rate ensuring consistency in the color temperature and intensity level of the rendered light. On the other hand, if different based materials are used for different types of de-saturated color LEDs, the different decay rates will cause the color temperature and intensity level of the rendered light to drift over time. As such, complicated circuits will need to be designed and implemented in the lighting fixture 100 to compensate the drifting. For example, existing light fixtures that utilize a saturated red LED group made with different base materials than the de-saturated green LED group and the de-saturated blue LED group require a dedicated circuitry to monitor the temperature of the saturated red LED group in order to compensate for the different decay rates of the three color LED groups. Using the same base material for all three de-saturated color LEDs eliminates the need for the compensation circuits.

Figure 3:
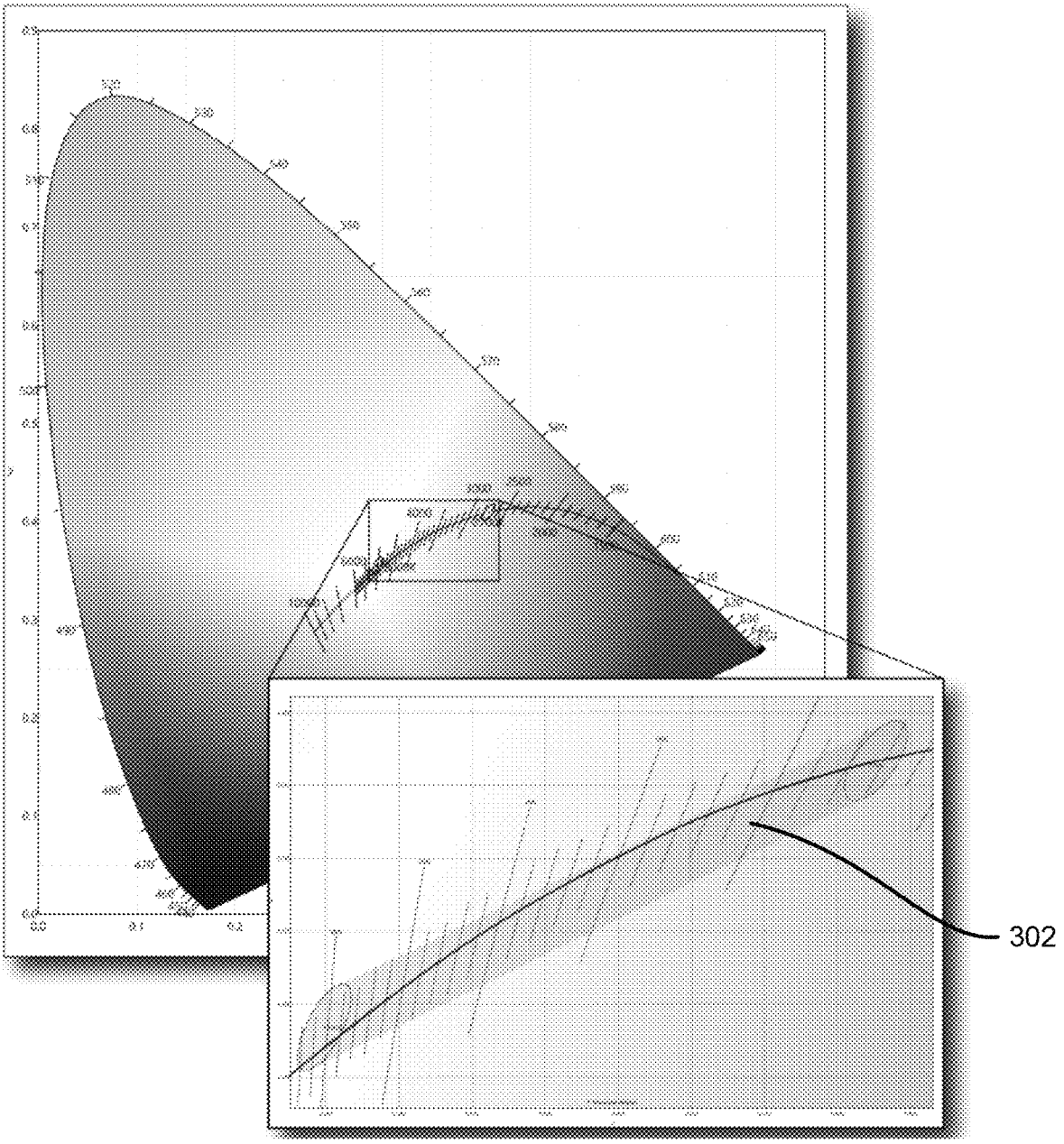
FIG. 3 (PRIOR ART)
FIG. 3 depicts an example of the color diagram using two white LED groups to generate light with different color temperatures.

Note that for all the color temperatures within the color temperature range, all three groups of LEDs are on at all times. The intensity of the lighting fixture is thus driven by the three groups of LEDs leading to a high lumen level per watt and thus a high efficiency at any color temperature. This is advantageous over existing methods that use a combination of different white LEDs to generate different color temperatures. FIG. 3 shows an example of the mechanism used by existing lighting fixtures for producing light at different color temperatures. In the example shown in FIG. 3, two white LED groups are used with one group producing light at a warm color temperature of 2,700K and the other group producing light at a cool color temperature of 5,000K. These two groups of LEDs are combined to generate light with a color temperature falling within the shaded area 302. At some color temperatures, such as at the two ends of the shaded area 302, one group of the LEDs has to be turned off in order to generate the desired color temperature, thereby resulting in a low lumen level per watt and thus a low efficiency for the lighting fixture.

Figure 4:
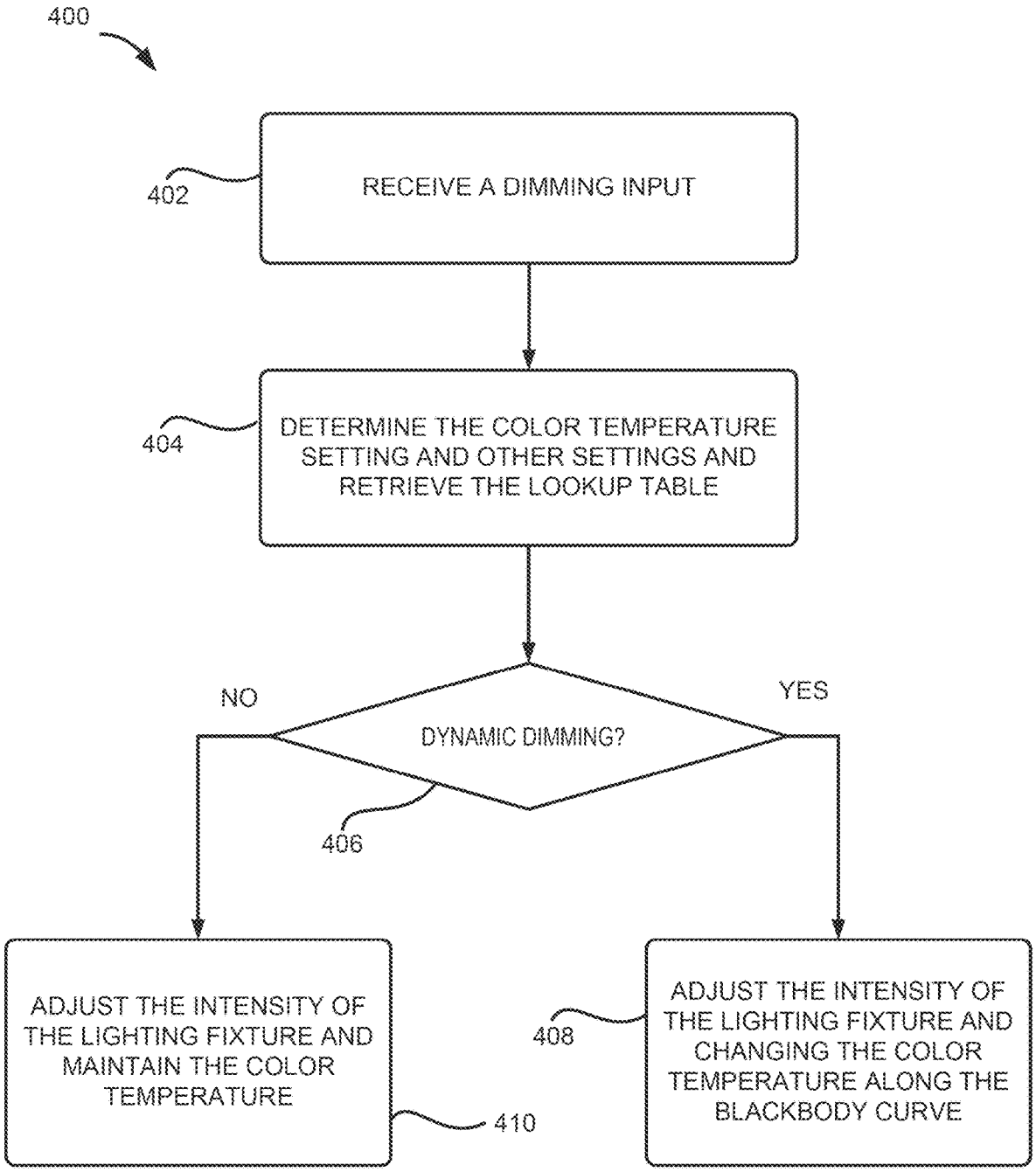
FIG. 4 depicts an example of a process for dimming the lighting fixture, according to certain embodiments of the present disclosure.

FIG. 4 depicts an example of a process 400 for dimming the lighting fixture, according to certain embodiments of the present disclosure. One or more components of the LED driver 102 (e.g., the control components) implement operations depicted in FIG. 4 by executing suitable program code. For illustrative purposes, the process 400 is described with reference to certain examples depicted in the figures. Other implementations, however, are possible.

At block 402, the process 400 involves receiving a dimming input. A user of the lighting fixture 100 can input the dimming input through the 0-10 v input 108, the triac controlling signal, a Bluetooth signal, or other types of signals. At block 404, the process 400 involves determining the color temperature setting 104 and other settings of the lighting fixture 100, such as the flux setting 106. The color temperature setting 104 and the flux setting 106 might be set by an installer of the lighting fixture 100 at the time of installation, through any of the interface available to the lighting fixture 100, such as the DIP switch, tactile buttons, break-away PCB tabs, traces or wired or wireless communication interfaces. These settings may be set according to user needs or preferences and may be changed when such needs or preferences change.

In one example, the lighting fixture 100 is configured with multiple color temperature settings with one or more color temperatures featuring the dynamic dimming. For example, the lighting fixture 100 can be configured with six color temperature settings of 2700K, 2856K, 3000K, 3500K, 4000K, and 5000K. Out of these six color temperature settings, color temperature setting 2856K is featured with the dynamic dimming. As such, the LED driver 102 can determine whether to implement the dynamic dimming based on the color temperature setting 104. In another example, the lighting fixture 100 is configured with a separate dynamic dimming input indicating whether the dynamic dimming should be implemented for the lighting fixture 100.

As discussed above, the color temperature and the intensity of the lighting fixture 100 are controlled by managing the intensities or RMS currents of the de-saturated color LED groups. To determine the RMS currents of the de-saturated color LED groups that correspond to the color temperature setting 104, the flux setting 106 and the dimming input setting 108, the LED driver 102 retrieves a lookup table that describes the relationship between the RMS currents and the color temperature and the intensity of the lighting fixture 100.

At block 406, the process 400 involves determining whether dynamic dimming should be implemented in response to the dimming input. The LED driver 102 can be configured for dynamic dimming if the current color temperature setting matches a color temperature setting configured with dynamic dimming or based on a separate dynamic dimming input. If the LED driver 102 determines that the dynamic dimming should be implemented, the process 400 involves, at block 408, determining the RMS intensities for the de-saturated color LED groups based on the lookup table so that the resulting color temperature of the lighting fixture 100 changes along the blackbody curve 204 as the lighting fixture 100 is being dimmed.

If the LED driver 102 determines that the dynamic dimming does not need to be implemented, the process 400 involves, at block 410, determining the RMS intensities for the de-saturated color LED groups based on the lookup table so that the resulting color temperature of the lighting fixture 100 remains the same as the lighting fixture 100 is being dimmed. The RMS intensities of the de-saturated color LED groups can be alternatively or additionally determined based on a formula describing the above relationship between the RMS currents and the color temperature and the intensity of the lighting fixture 100. The process 400 repeats when a new dimming input is received.

GENERAL CONSIDERATIONS

The color temperatures, intensities, number of LED groups, number and arrangements of LEDs in an LED group, and currents used in the above examples are exemplary. Other implementations may use different values, numbers, or arrangements and may use other types of lighting elements. The fixture may be any type of a fixture, including a linear fixture, a downlight, or a flush mount fixture. The LEDs of the different LED groups may be arranged so that the LEDs from different groups are interspersed in the fixture or may be arranged so that LEDs from different groups are separated in the fixture. Other light characteristics other than color temperature and intensity may also be changed or controlled.

A switch may use any type of component or combination of components to provide the described states or switching functions. A switch may include any type of mechanical, electrical, or software switch and a switch may be controlled or set directly or indirectly. A switch may be controlled by a user or by another component that is either part of the fixture or remote from the fixture.

Although the foregoing describes exemplary implementations, other implementations are possible. It will be appreciated that those skilled in the art, upon attaining an understanding of the foregoing, may readily produce alterations to, variations of, and equivalents to the described aspects. Accordingly, it should be understood that the present disclosure has been presented for purposes of example rather than limitation and does not preclude inclusion of such modifications, variations, and/or additions to the present subject matter as would be readily apparent to one of ordinary skill in the art.

Unless specifically stated otherwise, it is appreciated that throughout this specification discussions utilizing terms such as "processing," "computing," "calculating," "determining," and "identifying" or the like refer to actions or processes of a computing device, such as one or more computers or a similar electronic computing device or devices, that manipulate or transform data represented as physical electronic or magnetic quantities within memories, registers, or other information storage devices, transmission devices, or display devices of the computing platform.

The use of "adapted to" or "configured to" herein is meant as an open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

What is claimed is:

1. A lighting fixture, comprising:

a plurality of de-saturated color LED groups, each de-saturated color LED group configured to produce light with a color different from one another de-saturated color LED group, the plurality of de-saturated color LED groups comprising a de-saturated green LED group, a de-saturated blue LED group and a de-saturated red LED group, wherein each of the plurality of de-saturated color LED groups comprises a de-saturated color LED and the de-saturated color LED is configured to produce a de-saturated color; and a multi-channel driver, each of a plurality of channels of the driver configured for powering one of the plurality of de-saturated color LED groups, the multi-channel driver configured for controlling a color temperature of the lighting fixture by controlling an intensity of each of the plurality of de-saturated color LED groups, wherein a ratio between the intensities of the plurality of de-saturated color LED groups is determined based on a color temperature setting programmed in the multi-channel driver.

2. The lighting fixture of claim 1, wherein the multi-channel driver is further configured for:

controlling a lumen level of the lighting fixture by controlling the intensity of each of the plurality of de-saturated color LED groups, wherein the ratio between the intensities of the plurality of de-saturated color LED groups is determined based on the color temperature setting and a lumen level setting programmed in the multi-channel driver.

3. The lighting fixture of claim 1, wherein each of the plurality of de-saturated color LED groups comprises a plurality of de-saturated color LEDs, and wherein the plurality of de-saturated color LEDs in the plurality of de-saturated color LED groups are made using a same base material.

4. The lighting fixture of claim 3, wherein the plurality of de-saturated color LEDs in the plurality of de-saturated color LED groups are made using Indium gallium nitride (InGaN) LEDs.

5. The lighting fixture of claim 1, wherein the multi-channel driver is further configured for adjusting the intensity of the lighting fixture and maintaining the color temperature based on a dimming input signal.

6. The lighting fixture of claim 1, wherein the multi-channel driver is further configured for adjusting the intensity of the lighting fixture and changing the color temperature of the lighting fixture to follow a path that tracks a blackbody curve based on a dimming input signal.

7. The lighting fixture of claim 1, wherein the multi-channel driver is configured to determine the intensity of each of the plurality of de-saturated color LED groups based on a lookup table or an algorithm describing a relationship between the intensities of the plurality of de-saturated color LED groups and the color temperature of the lighting fixture.

8. The lighting fixture of claim 1, wherein controlling the intensity of each of the plurality of de-saturated color LED groups is performed by controlling a current of each of the plurality of de-saturated color LED groups or by controlling a duty cycle of a pulse width modulation (PWM) signal used to control the current of each of the plurality of de-saturated color LED groups.

9. The lighting fixture of claim 1, further comprising a user interface for setting the color temperature of the lighting fixture.

10. The lighting fixture of claim 9, wherein the user interface comprises at least one of a switch, a button, and a wireless signal.

11. A lighting fixture, comprising:

a plurality of de-saturated color LED groups comprising a de-saturated green LED group, a de-saturated blue LED group and a de-saturated red LED group, wherein each of the plurality of de-saturated color LED groups comprises a de-saturated color LED and the de-saturated color LED is configured to produce a de-saturated color; and a multi-channel driver configured for powering the plurality of de-saturated color LED groups, the multi-channel driver configured for controlling a color temperature of the lighting fixture by independently controlling an intensity of each of the plurality of de-saturated color LED groups.

12. The lighting fixture of claim 11, wherein the multi-channel driver is further configured for simultaneously adjusting an intensity of the lighting fixture and changing the color temperature of the lighting fixture along a blackbody curve based on a dimming input signal.

13. The lighting fixture of claim 11, wherein the multi-channel driver is configured to determine the intensity of each of the plurality of de-saturated color LED groups based on a lookup table describing a relationship between the intensities of the plurality of de-saturated color LED groups and the color temperature of the lighting fixture.

14. The lighting fixture of claim 11, wherein each of the plurality of de-saturated color LED groups comprises a plurality of de-saturated color LEDs, and wherein the plurality of de-saturated color LEDs in the plurality of de-saturated color LED groups are made using a same base material.

15. A method, comprising:

receiving a dimming input signal at a lighting fixture, the lighting fixture comprising a plurality of de-saturated color LED groups configured to produce light with a color different from one another, the plurality of de-saturated color LED groups comprising a de-saturated green LED group, a de-saturated blue LED group and a de-saturated red LED group, wherein each of the plurality of de-saturated color LED groups comprises a de-saturated color LED and the de-saturated color LED is configured to produce a de-saturated color;

determining a color temperature setting of the lighting fixture;

determining that dynamic dimming is to be implemented for the dimming input signal; and in response to determining that dynamic dimming is to be implemented for the dimming input signal, determining and adjusting an intensity of each of the plurality of de-saturated color LED groups to adjust the intensity of the lighting fixture based on the dimming input signal and to change a color temperature of the lighting fixture along a blackbody curve.

16. The method of claim 15, further comprising:

in response to determining that dynamic dimming is not to be implemented for the dimming input signal, determining and adjusting an intensity of each of the plurality of de-saturated color LED groups to adjust the intensity of the lighting fixture based on the dimming input signal and to maintain a color temperature of the lighting fixture at the color temperature setting.

17. The method of claim 15, wherein determining that dynamic dimming is to be implemented for the dimming input signal is performed based on the color temperature setting of the lighting fixture matching a color temperature setting for dynamic dimming.

18. The method of claim 15, wherein determining that dynamic dimming is to be implemented for the dimming input signal is performed based on a dynamic dimming input signal.

19. The method of claim 15, wherein determining the intensity of each of the plurality of de-saturated color LED groups is performed by querying a lookup table describing a relationship between the intensities of the plurality of de-saturated color LED groups, the color temperature and the intensity of the lighting fixture.

20. The method of claim 15, wherein adjusting the intensity of each of the plurality of de-saturated color LED groups is performed by adjusting a current of each of the plurality of de-saturated color LED groups or by adjusting a duty cycle of a pulse width modulation (PWM) signal used to control the current of each of the plurality of de-saturated color LED groups.

* * * * *